US010517413B1

(12) United States Patent
Soucy

(10) Patent No.: US 10,517,413 B1
(45) Date of Patent: Dec. 31, 2019

(54) TOP SECRET TOWEL SYSTEM

(71) Applicant: Angela Soucy, Dunedin, FL (US)

(72) Inventor: Angela Soucy, Dunedin, FL (US)

( * ) Notice: Subject to any disclaimer, the term of this patent is extended or adjusted under 35 U.S.C. 154(b) by 279 days.

(21) Appl. No.: 15/210,104

(22) Filed: Jul. 14, 2016

Related U.S. Application Data

(60) Provisional application No. 62/192,692, filed on Jul. 15, 2015.

(51) Int. Cl.
*A47G 9/06* (2006.01)
*A45C 3/10* (2006.01)

(52) U.S. Cl.
CPC ..... *A47G 9/062* (2013.01); *A45C 3/10* (2013.01); *A47G 9/06* (2013.01)

(58) Field of Classification Search
CPC . A47G 9/00; A47G 9/06; A47G 9/062; A47G 9/064; A47G 9/066; A47G 2009/006; A47K 10/00; A47K 10/02; A45C 3/10
See application file for complete search history.

(56) References Cited

U.S. PATENT DOCUMENTS 3,226,737 A * 1/1966 Rote ..... A47G 9/062 135/115
3,862,876 A * 1/1975 Graves ..... E04G 21/28 150/901
4,097,944 A * 7/1978 Yulish ..... A47G 9/062 5/419
4,195,378 A * 4/1980 Parker ..... A45C 3/10 190/2
4,222,468 A * 9/1980 De Fries ..... A45C 3/10 190/102
4,468,823 A * 9/1984 Tounjian ..... A47G 9/06 5/417
5,018,229 A * 5/1991 Eberhart ..... A47G 9/062 428/100
5,072,467 A * 12/1991 Hunt ..... A47G 9/062 401/201
5,075,918 A * 12/1991 Zeltner ..... A47L 13/16 15/114
5,361,435 A * 11/1994 Reeves ..... A45C 3/10 5/419
5,454,643 A * 10/1995 Sullivan ..... A45C 3/10 383/127
5,499,411 A * 3/1996 Wong ..... A47G 9/062 5/417
D388,273 S * 12/1997 Propper ..... A47G 9/062 5/417
5,758,373 A * 6/1998 Bloetjes ..... A47G 9/062 2/252

(Continued)

*Primary Examiner* — Peter M. Cuomo
*Assistant Examiner* — David R Hare

(57) ABSTRACT

A towel has a top edge, a bottom edge, a left side edge, a right side edge, a front face, and a back face. A pocket is formed of an inner sheet and an outer sheet. The pocket has an upper edge, a lower edge, a left side edge, and a right side edge. The inner sheet is in contact with the back face of the towel over a central extent of the inner sheet. The inner sheet is out of contact with the towel over a peripheral extent of the inner sheet. The outer sheet is positioned to overlie the inner sheet over a central extent of the outer sheet. The outer sheet is in contact with the back face of the towel over a peripheral extent of the outer sheet. The inner sheet and the outer sheet are fabricated of plastic.

2 Claims, 3 Drawing Sheets

(56) References Cited

U.S. PATENT DOCUMENTS 6,023,797 A * 2/2000 Brumfield ..... A47G 9/1045 383/4
6,192,536 B1 * 2/2001 Connors ..... A47G 9/062 383/4
6,952,845 B1 * 10/2005 Akkad ..... A45F 4/02 383/4
7,076,816 B1 * 7/2006 Nielsen ..... A47G 9/062 297/188.06
8,122,538 B2 * 2/2012 McBrearty ..... A47G 9/062 297/219.1
8,239,985 B2 * 8/2012 Christensen ..... A47G 9/062 5/417
8,959,679 B1 * 2/2015 Everds ..... A47G 9/062 206/38
2005/0005355 A1 * 1/2005 Marks ..... A47G 9/062 5/417
2005/0217048 A1 * 10/2005 Elie ..... A47K 10/02 15/209.1
2006/0010598 A1 * 1/2006 Rusinak-Connors ..... A47G 9/062 5/417
2008/0127414 A1 * 6/2008 Allen ..... A47G 9/062 5/417
2010/0017960 A1 * 1/2010 Blaauboer ..... A47G 9/062 5/417
2013/0062915 A1 * 3/2013 Ajrouche ..... A47C 31/11 297/188.2
2014/0059763 A1 * 3/2014 Paulat ..... A47G 9/062 5/417
2016/0037944 A1 * 2/2016 Savignano ..... A47G 9/062 5/644
2016/0058215 A1 * 3/2016 Meyer ..... A47G 9/062 428/36.1
2017/0027342 A1 * 2/2017 Mishra ..... A47G 9/062
2017/0086605 A1 * 3/2017 Wolfe ..... A47G 9/062

* cited by examiner 10
14
16
18
22
24
26
28
30
60
2

3
14
20
24
38
46
50
52
54
56
60
64

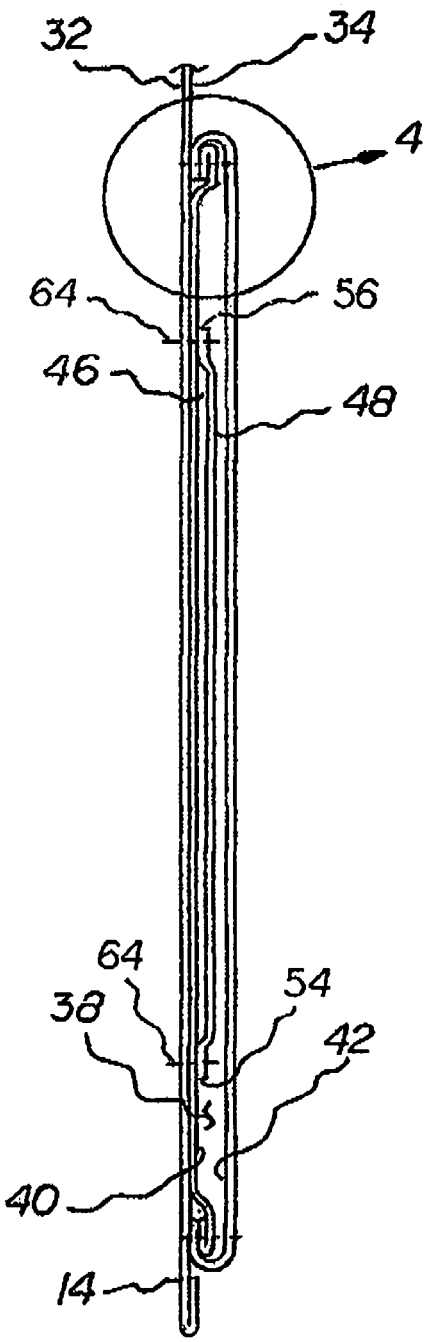
FIG. 3
FIG. 4
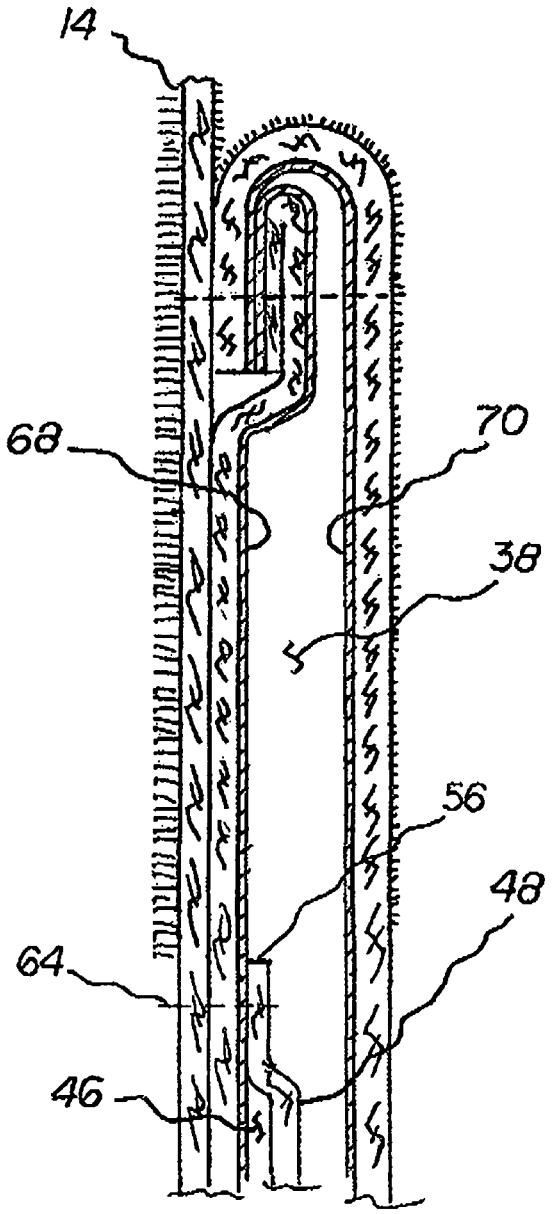

FIG. 5
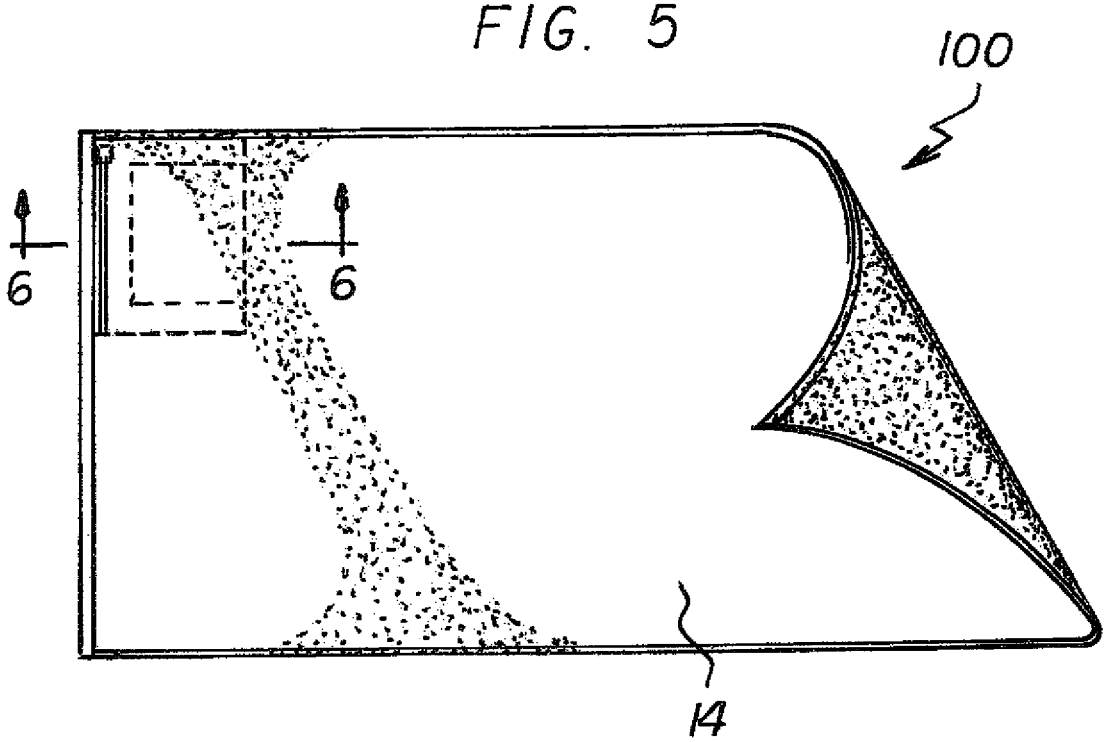
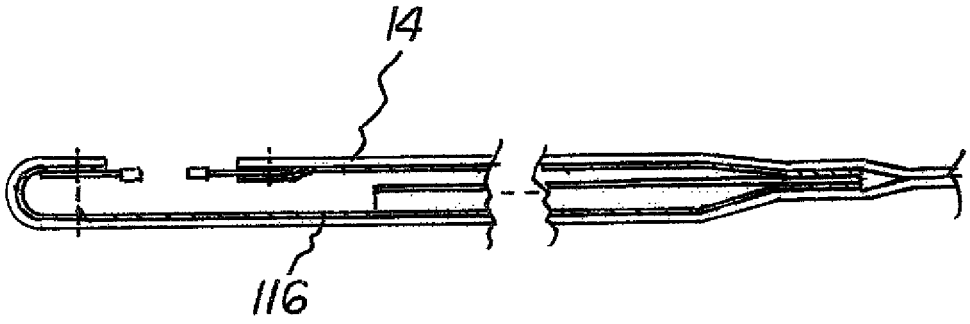
FIG. 6

TOP SECRET TOWEL SYSTEM

RELATED APPLICATION

This non-provisional application is based upon and claims the benefit of Provisional Application No. 62/192,692 filed Jul. 15, 2015, the subject matter of which is incorporated herein by reference.

BACKGROUND OF THE INVENTION

Field of the Invention

The present invention relates to a top secret towel system and more particularly pertains to providing a resting area on a sandy beach and for hiding valuables while on the sandy beach, the providing and the hiding being done in a safe, secure, convenient, and economical manner.

Description of the Prior Art

The use of beach towels of known designs and configurations is known in the prior art. More specifically, beach towels of known designs and configurations previously devised and utilized for the purpose of resting on a beach and hiding valuables are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a top secret towel system for providing a resting area on a sandy beach and for hiding valuables while on the sandy beach. The providing and hiding are done in a safe, secure, convenient, and economical manner.

In this respect, the top secret towel system according to the present invention substantially departs from the conventional concepts and designs of the prior art, and in doing so provides an apparatus primarily developed for the purpose of providing a resting area on a sandy beach and for hiding valuables while on the sandy beach. The providing and hiding are done in a safe, secure, convenient, and economical manner.

Therefore, it can be appreciated that there exists a continuing need for a new and improved top secret towel system which can be used to provide a resting area on a sandy beach and to hide valuables while on the sandy beach. The providing and hiding are done in a safe, secure, convenient, and economical manner. In this regard, the present invention substantially fulfills this need.

SUMMARY OF THE INVENTION

In view of the disadvantages inherent in the known types of beach towels of known designs and configurations now present in the prior art, the present invention provides an improved top secret towel system. As such, the general purpose of the present invention, which will be described subsequently in greater detail, is to providing a resting area on a sandy beach and for hiding valuables while on the sandy beach, the providing and the hiding being done in a safe, secure, convenient, and economical manner.

To attain this, from a broad viewpoint, the present invention is a top secret towel system. A towel is provided. The towel has a top edge, a bottom edge, a left side edge, a right side edge, a front face, and a back face. A major pocket is formed of an inner sheet and an outer sheet. The pocket has an upper edge, a lower edge, a left side edge, and a right side edge. The inner sheet is in contact with the back face of the towel over a central extent of the inner sheet. The inner sheet is out of contact with the towel over a peripheral extent of the inner sheet. The outer sheet is positioned to overlie the inner sheet over a central extent of the outer sheet. The outer sheet is in contact with the back face of the towel over a peripheral extent of the outer sheet. The inner sheet and the outer sheet are fabricated of plastic.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved top secret towel system which has all of the advantages of the prior art beach towels of known designs and configurations and none of the disadvantages.

It is another object of the present invention to provide a new and improved top secret towel system which may be easily and efficiently manufactured and marketed.

It is a further object of the present invention to provide a new and improved top secret towel system which is of durable and reliable constructions.

An even further object of the present invention is to provide a new and improved top secret towel system which is susceptible of a low cost of manufacture with regard to both materials and labor, and which accordingly is then susceptible of low prices of sale to the consuming public, thereby making such top secret towel system economically available to the buying public.

Lastly, it is an object of the present invention to provide a top secret towel system for providing a resting area on a sandy beach and for hiding valuables while on the sandy beach. The providing and hiding are done in a safe, secure, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3-3 of FIG. 2.

FIG. 4 is an enlarged cross sectional view taken at circle 4 of FIG. 3.

FIG. 5 is a plan view similar to FIG. 1 but illustrating an alternate embodiment of the invention.

FIG. 6 is a cross sectional view taken along line 6-6 of FIG. 5.

The same reference numerals refer to the same parts throughout the various Figures.

DESCRIPTION OF THE PREFERRED EMBODIMENT

Figure 1:
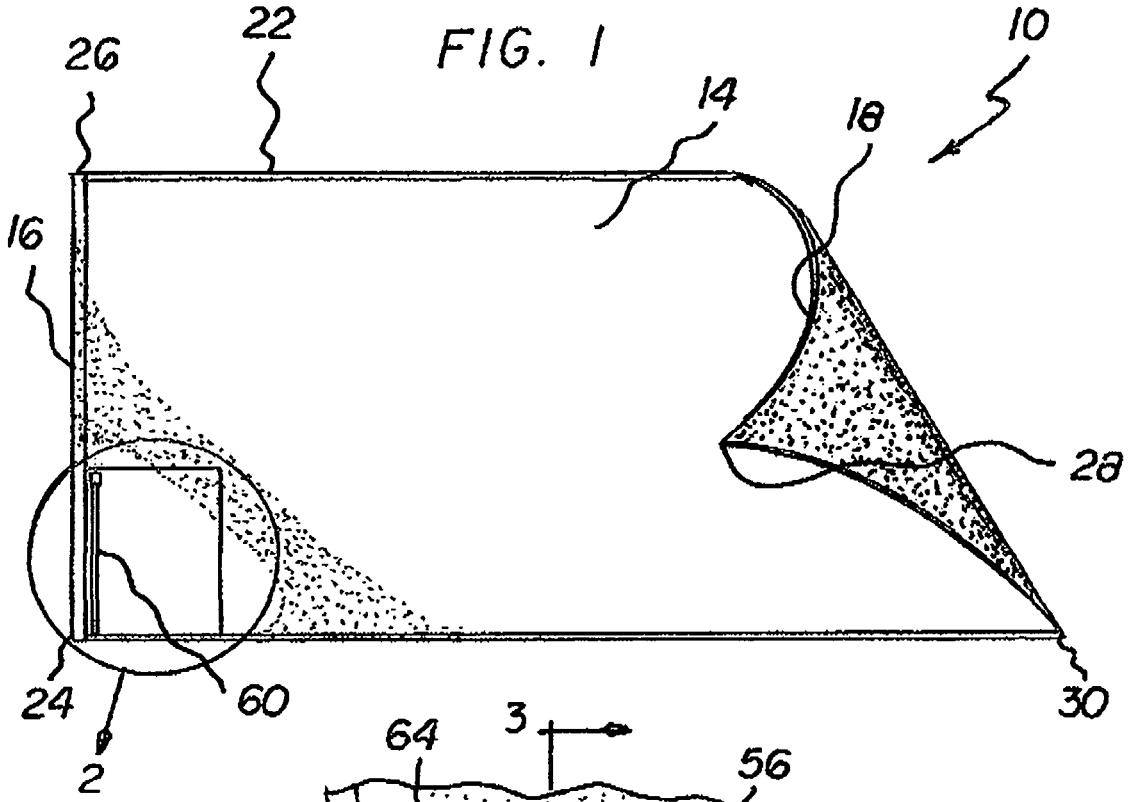
FIG. 1 is a perspective illustration of a top secret towel system constructed in accordance with the principles of the present invention.
Figure 2:
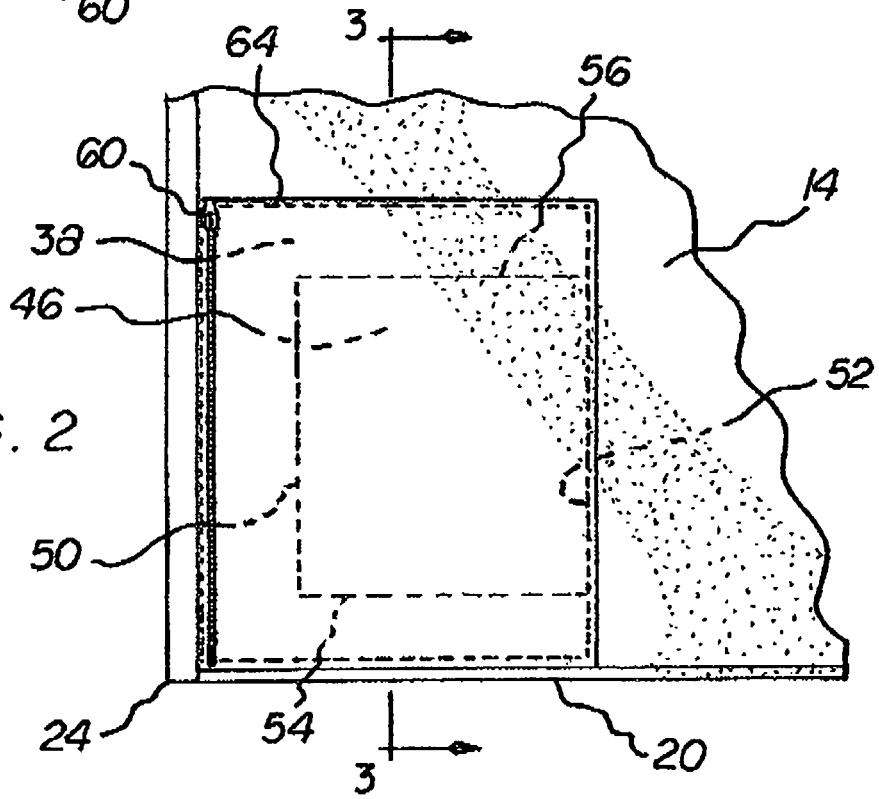
FIG. 2 is an enlarged plan view of a portion of the system taken at circle 2 of FIG. 1.

With reference now to the drawings, and in particular to FIG. 1 thereof, the preferred embodiment of the top secret towel system embodying the principles and concepts of the present invention and generally designated by the reference numeral 10 will be described.

The present invention, the top secret towel system 10 is comprised of a plurality of components. In their broadest context such include a towel and a pocket. Such components are individually configured and correlated with respect to each other so as to attain the desired objective.

From a specific viewpoint, the present invention is a top secret towel system. First provided is a towel 14. The towel has a top edge 16 and a parallel bottom edge 18. The towel has a left side edge 20 and a parallel right side edge 22. The towel has a first corner 24, a second corner 26, a third corner 28, and a fourth corner 30. The towel has a front face 32 and a back face 34.

A major pocket 38 is provided. The major pocket has an inner sheet 40, an outer sheet 42, an upper edge, a lower edge, a left side edge, and a right side edge. The inner sheet is rectangular with a first length and a first width. The inner sheet is in contact with the back face of the towel over a central extent of the inner sheet. The inner sheet is out of contact with the back face of the towel over a peripheral extent of the inner sheet. The outer sheet is rectangular with a second length and a second width. The second length is greater than the first length. The second width is greater than the first width. The outer sheet is positioned to overlie the inner sheet over a central extent of the outer sheet. The outer sheet is in contact with the back face of the towel over a peripheral extent of the outer sheet. The inner sheet and the outer sheet are fabricated of a waterproof plastic.

Also provided is a minor pocket 46. The minor pocket is formed of a single sheet 48. The single sheet is located between the inner sheet and the outer sheet. The single sheet is rectangular in configuration. The single sheet has a third length. The third length is less than the second length. The second sheet has a third width. The third width is less than the second width. The single sheet has an upper edge 50. The upper edge is spaced below the upper edge. The single sheet has a lower edge 52. The lower edge is spaced above the lower edge of the major pocket. The single sheet has a left side edge 54. The left side edge is spaced from the left side edge of the inner sheet. The single sheet has a right side edge 56. The right side edge overlies the right side edge of the major pocket.

Provided next is a sliding fastener 60. The sliding fastener is provided in the outer sheet adjacent to and parallel with the top edge of the towel. In this manner a primary passageway is provided for valuables.

Further provided is stitching 64. The stitching couples the left side edge, the right side edge, and the lower edge of the single sheet to the inner sheet. The upper edge of the single sheet is left unstitched. In this manner a secondary pocket is provided for valuables.

Provided last are a first aluminized Mylar sheet 68 and a second aluminized Mylar sheet 70. The first aluminized Mylar sheet is of a size and shape of the inner sheet. The first aluminized Mylar sheet is adhesively coupled to the outer sheet. The second aluminized Mylar sheet is of a size and shape of the inner sheet. The second aluminized Mylar sheet is adhesively coupled to the outer sheet. The first aluminized Mylar sheet and the second aluminized Mylar sheet are adapted to reflect away harmful rays of the sun.

Reference is now made to the alternate embodiment 100 of the invention illustrated in FIGS. 5 and 6. In this embodiment, a supplemental towel 116 overlies the first mentioned towel 14. The primary and secondary pockets are peripherally coupled to the first mentioned towel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A top secret towel system (10) for providing a resting area on a sandy beach and for hiding valuables while on the sandy beach, the providing and the hiding being done in a safe, secure, convenient, and economical manner, the system comprising, in combination:

a towel (14) having a top edge (16) and a parallel bottom edge (18), the towel having a left side edge (20) and a parallel right side edge (22), the towel having a first corner (24) and a second corner (26) and a third corner (28) and a fourth corner (30), the towel having a front face (32) and a back face (34);

a major pocket (38) formed of an inner sheet (40) and an outer sheet (42), the major pocket having an upper edge and a lower edge and a left side edge and a right side edge, the inner sheet being rectangular with a first length and a first width, the inner sheet being in contact with the back face of the towel over a central extent of the inner sheet, the inner sheet being out of contact with the back face of the towel over a peripheral extent of the inner sheet, the outer sheet being rectangular with a second length greater than the first length and a second width greater than the first width, the outer sheet positioned to overlie the inner sheet over a central extent of the outer sheet, the outer sheet being in contact with the back face of the towel over a peripheral extent of the outer sheet, the inner sheet and the outer sheet being fabricated of a waterproof plastic;

a minor pocket (46) formed of a single sheet (48) located completely between the inner sheet and the outer sheet, the single sheet formed in a rectangular configuration with a third length less than the second length and a third width less than the second width, the single sheet having an upper edge (50) parallel with and spaced below the top edge of the towel and a lower edge (52) parallel with and spaced above the lower edge of the major pocket, the single sheet having a left side edge (54) parallel with and spaced from the left side edge of the inner sheet, the single sheet having a right side edge (56) parallel with and overlying the right side edge of the major pocket;

a sliding fastener (60) in the outer sheet adjacent to and parallel with the top edge of the towel to create a primary passageway for valuables;

stitching (64) coupling the left side edge, the right side edge, and the lower edge of the single sheet to the inner sheet with upper edge of the single sheet unstitched to create a secondary packet for valuables; and a first aluminized Mylar sheet (68) and a second aluminized Mylar sheet (70), the first aluminized Mylar sheet of a size and shape of the inner sheet and adhesively coupled to the outer sheet, the second aluminized Mylar sheet of a size and shape of the inner sheet and adhesively coupled to the outer sheet, the first aluminized Mylar sheet and the second aluminized Mylar sheet adapted to reflect away harmful rays of the sun.

2. A top secret towel system for providing a resting area on a sandy beach and for hiding valuables while on the sandy beach, the system comprising, in combination:

a towel having a top edge and a parallel bottom edge, the towel having a left side edge and a parallel right side edge, the towel having a first corner and a second corner and a third corner and a fourth corner, the towel having a front face and a back face;

a major pocket formed of an inner sheet and an outer sheet, the major pocket having an upper edge and a lower edge and a left side edge and a right side edge, the inner sheet being rectangular with a first length and a first width, the inner sheet being in contact with the back face of the towel over a central extent of the inner sheet, the inner sheet being out of contact with the back face of the towel over a peripheral extent of the inner sheet, the outer sheet being rectangular with a second length greater than the first length and a second width greater than the first width, the outer sheet positioned to overlie the inner sheet over a central extent of the outer sheet, the outer sheet being in contact with the back face of the towel over a peripheral extent of the outer sheet, the inner sheet and the outer sheet being fabricated of a waterproof plastic;

a minor pocket formed of a single sheet located completely between the inner sheet and the outer sheet, the single sheet formed in a rectangular configuration with a third length less than the second length and a third width less than the second width, the single sheet having an upper edge parallel with and spaced below the top edge of the towel and a lower edge parallel with and spaced above the lower edge of the major pocket, the single sheet having a left side edge parallel with and spaced from the left side edge of the inner sheet, the single sheet having a right side edge parallel with and overlying the right side edge of the-major pocket;

a sliding fastener in the outer sheet adjacent to and parallel with the top edge of the towel to create a primary passageway for valuables;

stitching coupling the left side edge, the right side edge, and the lower edge of the single sheet to the inner sheet with upper edge of the single sheet unstitched to create a secondary packet for valuables; and a first aluminized Mylar sheet and a second aluminized Mylar sheet, the first aluminized Mylar sheet of a size and shape of the inner sheet and adhesively coupled to the outer sheet, the second aluminized Mylar sheet of a size and shape of the inner sheet and adhesively coupled to the outer sheet, the first aluminized Mylar sheet and the second aluminized Mylar sheet adapted to reflect away harmful rays of the sun; and a supplemental towel overlying the first mentioned towel and the primary and secondary pockets and peripherally coupled to the first mentioned towel.

* * * * *